US007469526B2

(12) United States Patent
Patrick et al.

(10) Patent No.: US 7,469,526 B2
(45) Date of Patent: Dec. 30, 2008

(54) HEAT/FIRE RESISTANT SEWING THREAD AND METHOD FOR PRODUCING SAME

(75) Inventors: Gilbert Patrick, 635 Dixon School Rd., Kings Mountain, NC (US) 28086; Robert Patrick, Gastonia, NC (US); Frank McNeely, Cherryville, NC (US)

(73) Assignee: Gilbert Patrick, Kings Mountain, NC (US)

( * ) Notice: Subject to any disclaimer, the term of this patent is extended or adjusted under 35 U.S.C. 154(b) by 0 days.

(21) Appl. No.: 11/733,910

(22) Filed: Apr. 11, 2007

(65) Prior Publication Data

US 2008/0199695 A1 Aug. 21, 2008

Related U.S. Application Data

(60) Provisional application No. 60/890,949, filed on Feb. 21, 2007.

(51) Int. Cl.
*D02G 3/02* (2006.01)

(52) U.S. Cl. ..... 57/229

(58) Field of Classification Search ..... 57/210, 57/224, 229

See application file for complete search history.

(56) References Cited

U.S. PATENT DOCUMENTS 4,257,221 A 3/1981 Feinberg
4,265,628 A 5/1981 Rossi et al.
4,573,500 A 3/1986 Bouglas
4,755,407 A 7/1988 Mortensen et al.
4,777,789 A 10/1988 Kolmes et al.
4,838,017 A 6/1989 Kolmes et al.
4,865,906 A 9/1989 Smith, Jr.
4,936,085 A 6/1990 Kolmes et al.
4,958,485 A 9/1990 Montgomery et al.
4,967,548 A 11/1990 Fangeat et al.
5,033,262 A 7/1991 Montgomery et al.
5,141,542 A 8/1992 Fangeat et al.
5,177,948 A 1/1993 Kolmes et al.
5,382,264 A 1/1995 Sharma
5,423,168 A 6/1995 Kolmes et al.
5,540,980 A 7/1996 Tolbert et al.
5,628,172 A 5/1997 Kolmes et al.
5,632,137 A 5/1997 Kolmes et al.
5,644,907 A 7/1997 Kolmes et al.
5,655,358 A 8/1997 Kolmes
5,845,476 A 12/1998 Kolmes
6,146,759 A 11/2000 Land
6,212,914 B1 4/2001 Kolmes et al.
6,230,524 B1 5/2001 Kolmes et al.
6,287,690 B1 9/2001 Land
6,309,746 B1 10/2001 Broutier et al.
6,341,483 B1 1/2002 Kolmes et al.
6,349,531 B1 2/2002 Kolmes et al.
6,351,932 B1 3/2002 Hummel (Continued)

*Primary Examiner*—Shaun R Hurley
(74) *Attorney, Agent, or Firm*—Womble Carlyle Sandridge & Rice PLLC

(57) ABSTRACT

A heat and flame resistant sewing thread having a core strand formed of glass material filaments is wrapped with a sheath of staple fibers spun about the core strand A lubricant is applied along the core strand to assist in the wrapping of the core strand with the sheath fibers. The sheath fibers include a series of microdenier fibers and generally will be ring spun about the core strand.

8 Claims, 1 Drawing Sheet

U.S. PATENT DOCUMENTS 6,363,703 B1 4/2002 Kolmes et al.
6,367,290 B2 4/2002 Kolmes et al.
6,381,940 B1 5/2002 Kolmes et al.
6,410,140 B1 6/2002 Land et al.
6,467,251 B1 10/2002 Kolmes
6,534,175 B1 * 3/2003 Zhu et al. ..... 428/365
6,553,749 B2 4/2003 Land et al.
RE38,136 E 6/2003 Kolmes
6,606,846 B2 8/2003 Land
6,952,915 B2 * 10/2005 Prickett ..... 57/211
7,111,445 B2 9/2006 Threlkeld et al.
7,134,266 B2 11/2006 Bourbon et al.
7,168,231 B1 1/2007 Chou et al.
2004/0002272 A1 1/2004 Land
2005/0025963 A1 2/2005 Zhu
2006/0048495 A1 3/2006 Threlkeld et al.
2006/0264136 A1 11/2006 Chiantese
2006/0266986 A1 11/2006 Day et al.

* cited by examiner

HEAT/FIRE RESISTANT SEWING THREAD AND METHOD FOR PRODUCING SAME

CROSS REFERENCE TO RELATED APPLICATIONS

The present patent application is a formalization of previously filed, co-pending U.S. provisional patent application Ser. No. 60/890,949, filed Feb. 21, 2007, by the inventors named in the present application. This patent application claims the benefit of the filing date of the cited provisional patent application according to the statutes and rules governing provisional patent applications, particularly USC § 119 (e)(1) and 37 CFR § 1.78(a)(4) and (a)(5). The specification and drawings of the provisional patent application are specifically incorporated herein by reference.

FIELD OF THE INVENTION

This invention generally relates to the production of sewing threads and in particular to a composite yarn having a core of heat and fire-retardant filaments of inherently low elongation encapsulated by high-strength, heat-resistant staple fibers to allow the composite thread to readily elongate in a commercial sewing process.

BACKGROUND OF THE INVENTION

There is a demand for sewing thread that is highly resistant to fire and heat for sewing together layers of fire-retardant fabrics such as for use in bedding, institutional window treatments, and for protective safety apparel. Impending U.S. Government regulations will mandate the use of such threads in products such as bedding, by as early as Jul. 1, 2007. Currently, the predominant product used for these type applications is made from para-aramid staple fibers such as Kevlar® or Twaron®. Because the elongation prior to breakage of these fibers is inherently low, such fibers typically exhibit less than exemplary sewing performance, such that sewing yarns produced from these fibers generally must be produced in very fine counts with at least two or three plies. The cost of such sewing yarns also can be exceptionally high due to their upwards of 100% content of very expensive para-aramid fibers.

For example, U.S. Pat. No. 7,111,445 to Kolmes and Threlkeld, discloses a fire resistant yarn and products made therefrom, with the composite yarn comprising a core of a conventional, non-fire-retardant strand. A fire-retardant, low-elongation yarn is wrapped around this core, followed by an outer wrap of a non-fire retardant yarn applied in the opposite direction. A bonding agent and a lubricant are applied in a final step. When exposed to high heat and/or flames, the core and outer sheath purportedly will melt and burn, leaving the inner wrapping intact with sufficient strength to hold together the layers of fabric. The chief advantage cited by this patent is that the low percentage of high-cost para-aramid yarns used yielding a substantially less expensive thread than conventional fire retardant yarns. However, there are disadvantages not disclosed that should be obvious to one skilled in the art. For example, the predominant fibers used in the core and outermost wrap that melt and/or burn at relatively low temperature can release toxic fumes into the environment. The residual para-aramid inner sheath remaining after such burn-off generally will have only a fraction of the tensile strength of conventional heat resistant yarns, and the bonding operation required often is very capital intensive and thus negates much of the claimed raw materials savings.

Therefore, it can be seen that a need exists for a more economical heat and fire-retardant sewing thread that addresses the foregoing and other related and unrelated problems in the art.

SUMMARY OF THE INVENTION

Briefly described, the present invention generally is directed to a sewing thread that has enhanced resistance to heat and fire or flame, and which is designed to be more economical to produce than conventional 100% spun meta-aramid and para-aramid sewing threads that are predominately used in such heat/flame retardant applications. The sewing thread of the present invention generally comprises a composite heat and flame resistant sewing thread having a core of glass filaments that generally have an elongation of less than approximately 4%. The core is wrapped in a sheath of microdenier para-aramid fibers that are ring spun about the core in a counterclockwise direction, with a level of twist sufficient to cause contraction of the core. Thereafter, a combination of at least two of the core/sheath strands is twisted in a clockwise direction with a twist sufficient to substantially negate or cancel-out torque effects created by twisting/spinning of the sheath fibers about the core in the counter-clockwise direction and to generate additional contraction of the core, which offers the potential for more elongation of the thread. The net effect is a "balanced" ply yarn that will not twist or kink when it is in a relaxed state such as occurs in sewing. Thereafter, a lubricant further can be applied to the composite sewing thread to help lower the friction between the thread and a needle during a later sewing operation, which could generate significant heat that could damage and weaken the thread to the point of breakage.

Various objects, features and advantages of the present invention will become apparent to those skilled in the art upon a reading of the following detailed description, when taken in conjunction with the accompanying drawing.

DETAILED DESCRIPTION OF THE INVENTION

Figure 1:
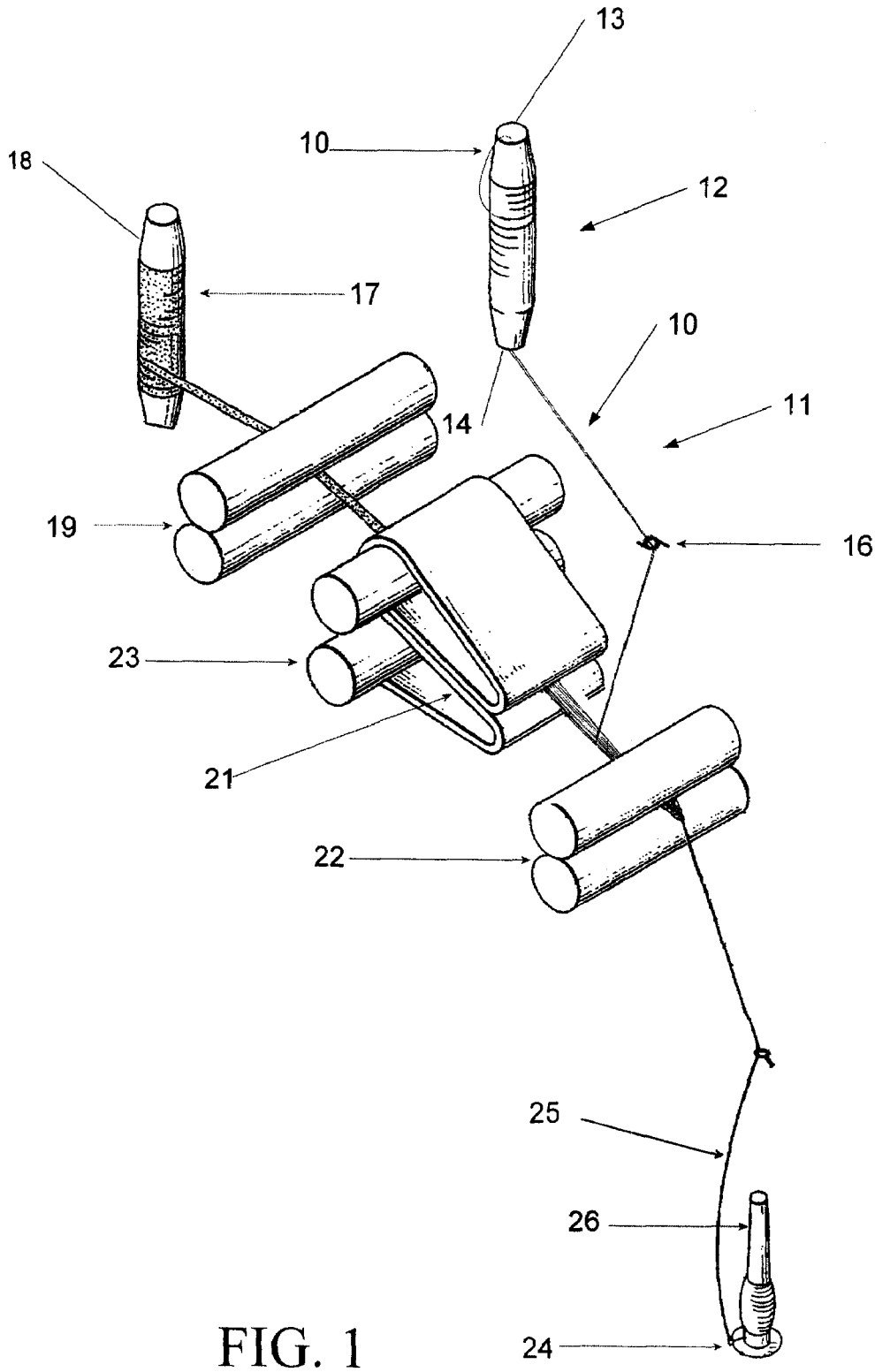
FIG. 1 is a schematic illustration of the spinning process for the heat and flame resistant thread of the present invention.

In one example embodiment, the composite heat and fire-resistant sewing thread of the present invention generally includes a core strand that is selected from a glass material. For example, the glass material of the core can include a 100% microdenier E-glass fiber or similar glass fiber material in a range of approximately 40-300 total denier, and more particularly about 90-99 total denier. Other fibers that additionally can be used for the core can include oxidized polyacrylonitrile, modacrylic, stainless steel, polytetrafluroethylene, polykeytone, polybenzaimidazole, and melamine formaldehyde and mixtures thereof. The core further includes approximately 100-300 individual filaments that can range from approximately 0.25-3.00 denier per filament. The fiberglass core strand is generally is formed by inserting about one twist per inch in the core strand and applying a bonding agent to stabilize the structure, which typically results in an elongation at break of about 1-5%, based upon a standard textile tensile strength test wherein the strand/thread/yarn is stretched until it breaks.

Plain un-textured fiberglass filaments typically are substantially straight and very brittle so as to break in response to relatively little force because they do not elongate. Accordingly, twisting of the glass fibers is used to bind the straight fibers together and further generate contraction of the glass fibers, which enables subsequent elongation of the core. This crimp/deflection gives the multi-filament core strand the potential to stretch or elongate. This elongation of the fiberglass core in the present invention enables the much stronger para-aramid fibers in the sheath of the thread to assume most of the load when a strong force is applied to the thread, as occurs in sewing. The glass filaments of the core strand 10 (FIG. 1) then can be bonded with a starch/oil or other similar coating for wrapping with the sheath fibers.

The sheath includes a series of fibers that generally can comprise a meta-aramid or para-aramid microdenier fiber such as Twaron® fibers having a denier per filament of approximately 0.99 or less. Alternatively, various non-microdenier fibers ranging from 1.0 to about 3 denier per filament and other material fibers such as oxidized polyacrylonitrile, modacrylic, stainless steel, polytetrafluroethylene, polykeytone, polybenzaimidazole, meta-aramid, and para-aramid or mixtures thereof, also can be used. The sheath fibers generally are cut to a staple length of approximately 20-220 millimeters, and further typically are prepared by processing the fibers through conventional cotton spinning equipment in which the fibers can be opened, blended, carded, drawn, and passed through roving as needed or desired. The technical parameters for carding para-aramid microdenier fibers also are altered from those normally utilized in processing cotton and common synthetics to facilitate carding of such durable fibers.

The fiberglass core strand is placed in the creel of a ring spinning frame as shown in FIG. 1. In contrast to conventional ring frames fed from bobbins of roving materials that are hung in the creel from roving bobbin holders that rotate to allow the roving to unwind from the side of the rotating bobbins. With the present invention, a fiberglass core strand 10 is supplied to a spinning frame in packages called "pirns" 12 that are designed to rest on a stationary base. The fiberglass yarn is then fed off over the top of the pirn, through a hole 13 in the top of the pirn. Thereafter, the yarn passes along and out from the bottom of the pirn through a tensioning device 14 and through a thread guide 16 for feeding into the spinning elements of the spinning frame 11 for spinning a sheath or strand of staple fibers 17 around the fiberglass filament core 10. The staple meta-aramid or para-aramid fibers 17 generally are fed from a rotating bobbin 18 through feed rolls 19. After passing through drafting aprons 21, which are driven by rolls 23, the staple fibers are combined with the fiberglass core thread/filaments 10 and are wrapped thereabout to form a sheath. The sheath fibers are spun about the core filament by spindles rotating in the counterclockwise direction to produce a reverse, or "S" twist in the resultant sewing thread 25.

The creel apparatus allows the fiberglass filament core strand to be fed through the center of the thread carrier into a guide 16 located precisely between the nip of the drafting aprons 21 and the front drafting rolls 22. Alternatively, the guide 16 can be positioned behind the feed rolls 19, which allows it to be attached to the roving traversing mechanism (not illustrated). The para-aramid staple fiber roving then is drafted into a thin ribbon that wraps around the fiberglass core upon exiting the nip of the front drafting rollers 22. A conventional ring and traveler 24 execute the twisting and take-up functions onto a tube or bobbin 26. The resultant core/sheath thread 25 can be in a range of sizes from about 10/1 Ne (about 530-535 denier) to about 40/1 Ne (about 130-135 denier), and preferably will be about a 20/1 Ne count which is equivalent to approximately 260-266 denier, with the thread initially having approximately 10-25 turns of "S" reverse twist per inch of thread and the core accordingly being contracted. As a result, the core filaments are reoriented so that they are no longer parallel, but rather are helically oriented.

In addition, at least a portion of the combined core/sheath strands is formed by twisting in the clockwise direction with a twist generally sufficient to substantially negate or cancel the torque effects of the counter-clockwise twisting and to further generate additional contraction of the core. After spinning, a number of the small bobbins are spliced together in the winding process, which also helps clear any physical defects in the thread. Then, in the doubling process, two or more strands are wound parallel onto a creel package in preparation for the twisting operation. Twisting generally is done on a hollow-spindle two-for-one machine or could be accomplished on a standard ring twister. Approximately nine (9) turns per inch of "Z" twist generally are inserted in the core/sheath thread, although this could range from about five to fifteen turns per inch to provide a zero torque or "balanced" yarn depending upon the size and the twist level of the single thread. It should be noted that "Z" ply twist is in the reverse, or clockwise direction to standard "S" twist to accommodate the reverse "S" twist used in the spinning of the composite sewing thread.

The final process is spooling where small bobbin spools, king spools, and cones used in commercial sewing are formed. A fiber-metal lubricant, such as paraffin wax emulsion, such as Lubrol® produced by Boehme Filatex, mineral oil, silicone, or other similar material and combinations thereof will be applied to the composite sewing thread at levels ranging from approximately 8%-12%. The lubricant can be sprayed or applied to the thread by a "kiss" roll in which a smooth steel roller is partially immersed in a trough filled with the lubricant. As the thread is wound onto the final spool, its path is deflected so that the thread passes over the roller covered with lubricant. The rotational speed of the kiss roller also can be varied to control the amount of lubricant that is applied. The lubricant is designed to help reduce the coefficient of friction between the hard para-aramid sheath fibers and a sewing needle during later sewing operations.

In tests of the composite heat/flame resistant sewing thread of the present invention, the sewing thread was tested with a conventional 30/3 Kevlar® 100% aramid fiber thread, which had a materials cost of about 25-20% higher compared with the present invention. The sewing thread of the present invention and the 30/3 Kevlar® thread were tested for tensile strength and elongation on a Textechno Statimat M Tester according to ASTM Standard Test Method D2256-97. The test parameters included using a 10 kilogram load cell, 250 mm gauge length a preload of 0.50 cN/tex on the samples, and a test speed of 305 mm/min. A sewing breakage test also was run on the samples of the thread of the present invention and the 30/3 Kevlar® thread. This test was conducted on a Brother Excedra model DB1-B737-413 Mark II 301 Lockstitch sewing machine using test parameters of 25 grams tension, a 5000 stitches per minute operating speed, a 12 stitches per inch feed rate and with the sewing machine having a #18/metric sewing needle. Ten parallel passes were made in both directions in a 12"×12" square of 14 oz. denim material. The results of these tests are summarized below.

TEST AND TRIAL RESULTS

| | Tensile Strength | % Elongation | Sewing Thread Breaks | Linting |
|---|---|---|---|---|
| Present Invention | 10.16 lbs. | 3.83% | Zero | Low |
| 30/3 Kevlar ® thread | 10.10 lbs. | 4.30% | Zero | Moderate |

Accordingly, it has been found that the heat/fire resistant thread of the present invention has very similar properties relating to strength, elongation, and breakage as those of a conventional 30/3 Kevlar® thread, but was found to exhibit better linting, and can be produced at a cost of approximately 25-30% lower than such conventional 30/3 Kevlar® 100% aramid fiber threads.

It will be understood by those skilled in the art that while the foregoing has been described with reference to preferred embodiments and features, various modifications, variations, changes and additions can be made thereto without departing from the spirit and scope of the invention.

The invention claimed is:

1. A heat and flame resistant sewing thread, comprising:

a core strand comprising glass material filaments having an elongation of between about 1% to about 5%;

a sheath of substantially heat resistant staple fibers, including microdenier aramid fibers selected from the group comprising meta-aramid and para-aramid fibers, ring spun about said core strand in a counterclockwise direction with a level of twist sufficient to cause contraction of said core strand; and wherein at least a portion of said core strand and said staple fibers of said sheath spun about core strand is subjected to twisting in a clockwise direction with a level of twist sufficient to negate torque effects resulting from ring spinning said microdenier fibers about said core strand and to generate additional contraction of said core strand.

2. The heat and flame resistant sewing thread of claim 1 further comprising a lubricant.

3. The heat and flame resistant sewing thread of claim 1 wherein said core strand has a total denier ranging from about 40 denier to about 300 denier and comprises individual filaments ranging from about 0.25 denier to about 2.00 denier.

4. The heat and flame resistant sewing thread of claim 1 wherein said core strand further comprises a series of heat resistant fibers selected from the group comprising oxidized polyacrylonitrile, modacrylic, stainless steel, polytetrafluroethylene, polykeytone, polybenzaimidazole, and melamine formaldehyde and mixtures thereof.

5. The heat and flame resistant sewing thread of claim 1 wherein said staple fibers of said sheath comprise deniers per filament of about 0.99 or less.

6. The heat and flame resistant sewing thread of claim 1 wherein said staple fibers of said sheath comprise deniers per filament of at least about 1.00.

7. The heat and flame resistant sewing thread of claim 1, wherein said staple fibers of said sheath further comprise a series of fibers from the group comprising oxidized polyacrylonitrile, modacrylic, stainless steel, polytetrafluroethylene, polykeytone, polybenzaimidazole, and mixtures thereof.

8. The heat and flame resistant sewing thread of claim 1 wherein said glass filaments of said core strand and said staple fibers of said sheath range in size from about 10/1 Ne to about 40/Ne.

* * * * *